US006229877B1

(12) United States Patent
Agano

(10) Patent No.: US 6,229,877 B1
(45) Date of Patent: May 8, 2001

(54) RADIATION IMAGE RECORDING AND READ-OUT METHOD AND APPARATUS

(75) Inventor: Toshitaka Agano, Kanagawa-ken (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/376,349

(22) Filed: Aug. 18, 1999

(30) Foreign Application Priority Data

Aug. 18, 1998 (JP) ..... 10-231294

(51) Int. Cl.[7] ..... G21K 1/00

(52) U.S. Cl. ..... 378/154; 378/98.2; 250/580; 250/584

(58) Field of Search ..... 378/154, 98.2; 358/447, 298; 250/590, 584, 580

(56) References Cited

U.S. PATENT DOCUMENTS

| | | | | |
|---|---|---|---|---|
| 4,803,359 | | 2/1989 | Hosoi et al. | 250/327.2 |
| 4,882,489 | * | 11/1989 | Saotome et al. . | |
| 5,028,784 | * | 7/1991 | Arakawa et al. . | |
| 5,187,369 | | 2/1993 | Kingsley et al. | 250/370.11 |

FOREIGN PATENT DOCUMENTS

| | | | |
|---|---|---|---|
| 1-216290 | 8/1989 | (JP) | G01T/1/24 |
| 2-164067 | 6/1990 | (JP) | H01L/27/146 |

OTHER PUBLICATIONS

"Signal, noise, and readout considerations in the development of amorphous silicon photodiode arrays for radiotherapy and diagnostic x–ray imaging", L.E. Antonuk et al., University of Michigan, R.A. Street Xerox, PARC, SPIE vol. 1443, Medical Imaging V; Image Physics (1991), pp. 108–119.

"Material Parameters in Thick Hydrogenated Amorphous Silicon Radiation Detectors", Qureshi et al; Lawrence Berkeley Laboratory, University of California.

"Metal/Amorphous Silicon Multilayer Radiation Detectors" Naruse et al., IEEE Transactions on Nuclear Science, vol. 36, No. 2, Apr. 1989.

* cited by examiner

*Primary Examiner*—Robert H. Kim
*Assistant Examiner*—Pamela R. Hobden
(74) *Attorney, Agent, or Firm*—Sughrue, Mion, Zinn, Macpeak & Seas, PLLC

(57) ABSTRACT

A radiation source, which produces radiation, is located on one side of an object, two-dimensional image read-out device is located on the other side of the object, the two-dimensional image read-out device comprising stripe-shaped electrodes for reading latent image charges, which carry image information, and an operation for recording and reading out a radiation image of the object is performed. A grid plate is located between the object and the two-dimensional image read-out device, the grid plate guiding only the radiation, which comes from a specific direction, to the two-dimensional image read-out device. The operation for recording and reading out the radiation image of the object is performed in this state, and deterioration in image quality due to scattered radiation is prevented.

21 Claims, 6 Drawing Sheets

RADIATION IMAGE RECORDING AND READ-OUT METHOD AND APPARATUS

BACKGROUND OF THE INVENTION

1. Field of the Invention

This invention relates to a radiation image recording and read-out method and apparatus. This invention particularly relates to prevention of deterioration in image quality due to scattered radiation.

2. Description of the Prior Art

Operations for recording radiation images are carried out in various fields. For example, radiation images to be used for medical purposes are recorded as in X-ray image recording for medical diagnoses. Also, radiation images to be used for industrial purposes are recorded as in radiation image recording for non-destructive inspection of substances. In order to carry out such operations for recording radiation images, there has heretofore been utilized the so-called "radiography" in which radiation films and intensifying screens are combined with each other. With the radiography, when radiation, such as X-rays, carrying image information of an object impinges upon the intensifying screen, a fluorescent material contained in the intensifying screen absorbs energy from the radiation and produces fluorescence (i.e. instantaneously emitted light). Therefore, the radiation film, which is superposed upon the intensifying screen in close contact therewith, is exposed to the fluorescence produced by the fluorescent material, and a radiation image is thereby formed on the radiation film. In this manner, the radiation image can be directly obtained as a visible image on the radiation film.

The applicant proposed radiation image read-out apparatuses, which are referred to as the computed radiography (CR) apparatuses. With the proposed CR apparatuses, a stimulable phosphor sheet, on which a radiation image has been stored, is exposed to stimulating rays, such as a laser beam, which cause it to emit light in proportion to the amount of energy stored thereon during its exposure to radiation. The light emitted by the stimulable phosphor sheet, upon stimulation thereof, is photoelectrically detected and converted into an electric image signal. The image signal having been obtained from the CR apparatuses is utilized for reproducing and displaying a visible image on a cathode ray tube (CRT) display device or for reproducing a visible image on film by a laser printer (LP), or the like. The reproduced image is utilized for making a diagnosis, e.g. for investigating the presence or absence of a diseased part or an injury or for ascertaining the characteristics of the diseased part or the injury.

However, in order for a radiation image to be obtained by utilizing radiation film, when the radiation image is to be visualized directly, it is necessary for sensitivity regions of the radiation film and the intensifying screen to be set so as to coincide with each other during the image recording operation. Also, it is necessary for a developing process to be carried out on the radiation film. Therefore, the problems occur in that considerable time and labor are required to obtain the radiation image by utilizing the radiation film.

Further, with the apparatuses for photoelectrically reading out a radiation image from radiation film or a stimulable phosphor sheet, the radiation image must be converted into an electric image signal, and image processing must be performed on the image signal such that a visible image having desired image density and contrast may be obtained. For such purposes, it is necessary for the scanning for reading out the radiation image to be performed by utilizing image read-out means. Therefore, operations for obtaining a visible radiation image cannot be kept simple, and considerable time is required to obtain the visible radiation image.

Such that the problems encountered with the conventional techniques may be solved, apparatuses utilizing semiconductor devices (referred to as the solid-state radiation detectors), which detect radiation and convert it into an electric signal, have been proposed. As the solid-state radiation detectors, various types of radiation detectors have been proposed. One of typical solid-state radiation detectors comprises two-dimensional image read-out means and a fluorescent material layer (i.e., a scintillator) overlaid upon the two-dimensional image read-out means. The two-dimensional image read-out means comprises an insulating substrate and a plurality of photoelectric conversion devices, which are formed in a two-dimensional pattern on the insulating substrate and each of which corresponds to one pixel. When the scintillator is exposed to radiation carrying image information, it converts the radiation into visible light carrying the image information. (The solid-state radiation detector having such a constitution will hereinbelow be referred to as the "photo conversion type of solid-state radiation detector.") Another typical solid-state radiation detector comprises two-dimensional image read-out means and a radio-conductive material overlaid upon the two-dimensional image read-out means. The two-dimensional image read-out means comprises an insulating substrate and a plurality of charge collecting electrodes, which are formed in a two-dimensional pattern on the insulating substrate and each of which corresponds to one pixel. When the radio-conductive material is exposed to radiation carrying image information, it generates electric charges carrying the image information. (The solid-state radiation detector having such a constitution will hereinbelow be referred to as the "direct conversion type of solid-state radiation detector.")

The photo conversion types of solid-state radiation detectors are described in, for example, Japanese Unexamined Patent Publication Nos. 59(1984)-211263 and 2(1990)-164067, PCT International Publication No. WO92/06501, and "Signal, Noise, and Read Out Considerations in the Development of Amorphous Silicon Photodiode Arrays for Radiotherapy and Diagnostic X-ray Imaging," L. E. Antonuk et al., University of Michigan, R. A. Street Xerox, PARC, SPIE Vol. 1443, Medical Imaging V; Image Physics (1991), pp. 108–119.

Examples of the direct conversion types of solid-state radiation detectors include the following:

(i) A solid-state radiation detector having a thickness approximately 10 times as large as the ordinary thickness, the thickness being taken in the direction along which radiation is transmitted. The solid-state radiation detector is described in, for example, "Material Parameters in Thick Hydrogenated Amorphous Silicon Radiation Detectors," Lawrence Berkeley Laboratory, University of California, Berkeley, Calif. 94720 Xerox Parc. Palo Alto. Calif. 94304.

(ii) A solid-state radiation detector comprising two or more layers overlaid via a metal plate with respect to the direction along which radiation is transmitted. The solid-state radiation detector is described in, for example, "Metal/Amorphous Silicon Multilayer Radiation Detectors, IEE TRANSACTIONS ON NUCLEAR SCIENCE, Vol. 36, No. 2, April 1989.

(iii) A solid-state radiation detector utilizing CdTe, or the like. The solid-state radiation detector is proposed in, for example, Japanese Unexamined Patent Publication No. 1(1989)-216290.

Also, in Japanese Patent Application No. 9(1997)-222114, the applicant proposed a solid-state radiation detector improved over the direct conversion type of solid-state radiation detector. (The proposed solid-state radiation detector will hereinbelow be referred to as the "improved direct conversion type of solid-state radiation detector.")

The improved direct conversion type of solid-state radiation detector comprises:

i) a first electrical conductor layer having permeability to recording radiation, ii) a recording photo-conductive layer, which exhibits photo-conductivity when it is exposed to the recording radiation having passed through the first electrical conductor layer, iii) a charge transporting layer, which acts approximately as an insulator with respect to electric charges having a polarity identical with the polarity of electric charges occurring in the first electrical conductor layer, and which acts approximately as a conductor with respect to electric charges having a polarity opposite to the polarity of the electric charges occurring in the first electrical conductor layer, iv) a reading photo-conductive layer, which exhibits photo-conductivity when it is exposed to a reading electromagnetic wave, and v) a second electrical conductor layer having permeability to the reading electromagnetic wave, the layers being overlaid in this order.

In the improved direct conversion type of solid-state radiation detector, latent image charges carrying image information are accumulated at an interface between the recording photo-conductive layer and the charge transporting layer.

In the improved direct conversion type of solid-state radiation detector, the latent image charges may be read with a technique, wherein the second electrical conductor layer (i.e., a reading electrode) is constituted of a flat plate-shaped electrode, and the reading electrode is scanned with spot-like reading light, such as a laser beam, the latent image charges being thereby detected. Alternatively, the latent image charges may be read with a technique, wherein the reading electrode is constituted of comb tooth-shaped electrodes (i.e., stripe-shaped electrodes), and the stripe-shaped electrodes are scanned with light, which is produced by a line light source extending along a direction approximately normal to the longitudinal direction of each stripe-shaped electrode, and in the longitudinal direction of each stripe-shaped electrode, the latent image charges being thereby detected.

An image signal, which has been obtained from one of various types of solid-state radiation detectors described above, is amplified by an amplifier of the solid-state radiation detector. The amplified image signal is then subjected to predetermined image processing and used for reproducing a visible image on image reproducing means, such as a cathode ray tube (CRT) display device. With such solid-state radiation detectors, a visible radiation image of an object can be reproduced immediately in a real time mode and without complicated operations being required. Therefore, the problems encountered with the aforesaid apparatuses utilizing radiation film, or the like, can be eliminated.

With each of the radiation image recording and read-out apparatuses utilizing various types of solid-state radiation detectors described above, in cases where a radiation image of an object is to be read out with the solid-state radiation detector, radiation having been produced by a radiation source is irradiated to the object, and the radiation carrying image information of the object is detected by the solid-state radiation detector.

However, the radiation is scattered to various directions in the object, and signal components caused to occur by the scattered radiation mix in the image signal, which carries the image information of the object. Therefore, the problems occur in that a sufficiently high signal-to-noise ratio cannot be obtained, or high resolution cannot be obtained. As a result, a visible image having good image quality cannot be obtained.

SUMMARY OF THE INVENTION

The primary object of the present invention is to provide a radiation image recording and read-out method utilizing a solid-state radiation detector, wherein deterioration in image quality due to scattered radiation is prevented.

Another object of the present invention is to provide an apparatus for carrying out the radiation image recording and read-out method.

The present invention provides a first radiation image recording and read-out method, comprising the steps of:

i) locating a radiation source, which produces radiation, on one side of an object, ii) locating two-dimensional image read-out means on the other side of the object, the two-dimensional image read-out means comprising stripe-shaped electrodes for reading latent image charges, which carry image information, and iii) performing an operation for recording and reading out a radiation image of the object, wherein a grid plate is located between the object and the two-dimensional image read-out means, the grid plate guiding only the radiation, which comes from a specific direction, to the two-dimensional image read-out means, and the operation for recording and reading out the radiation image of the object is performed in this state.

The present invention also provides a first radiation image recording and read-out apparatus for carrying out the first radiation image recording and read-out method in accordance with the present invention. The first radiation image recording and read-out apparatus in accordance with the present invention is provided with the improved direct conversion type of solid-state radiation detector described above and will hereinbelow be referred to as the "improved direct conversion type of radiation image recording and read-out apparatus."

Specifically, the present invention also provides a first radiation image recording and read-out apparatus, comprising:

i) a radiation source, which produces radiation, ii) two-dimensional image read-out means comprising stripe-shaped electrodes for reading latent image charges, which carry image information, and iii) a grid plate, which is located between the radiation source and the two-dimensional image read-out means, the grid plate guiding only the radiation, which comes from a specific direction, to the two-dimensional image read-out means.

The first radiation image recording and read-out apparatus in accordance with the present invention should preferably be constituted such that the stripe-shaped electrodes of the two-dimensional image read-out means are arrayed at a predetermined pitch so as to stand side by side in a direction, which is approximately normal to a longitudinal direction of each stripe-shaped electrode, the grid plate is constituted of radiation absorbing substance regions and radiation-permeable substance regions, which are arrayed alternately at a predetermined grid pitch so as to stand side by side in the direction approximately normal to the longitudinal direction of each stripe-shaped electrode, (i.e., the stripe-shaped electrodes and the radiation absorbing substance regions of the grid plate are arrayed in parallel with each other) and a spatial frequency fC of the pitch of the stripe-shaped electrodes is at least two times as high as a spatial frequency fG of the grid pitch.

The term "spatial frequency fC of a pitch of stripe-shaped electrodes" as used herein means the frequency represented by the formula of fC=1/PC, in which PC represents the pitch of the stripe-shaped electrodes. Also, the term "spatial frequency fG of a grid pitch" as used herein means the frequency represented by the formula of fG=1/PG, in which PG represents the grid pitch. (This also applies to radiation image recording and read-out apparatuses in accordance with the present invention provided with two-dimensional image read-out means constituting other conversion types of solid-state radiation detectors, which will be described later.)

Also, the first radiation image recording and read-out apparatus in accordance with the present invention should preferably be constituted such that the stripe-shaped electrodes of the two-dimensional image read-out means are arrayed at a predetermined pitch so as to stand side by side in a direction, which is approximately normal to a longitudinal direction of each stripe-shaped electrode, the grid plate is constituted of radiation absorbing substance regions and radiation-permeable substance regions, which are arrayed alternately at a predetermined grid pitch so as to stand side by side in the longitudinal direction of each stripe-shaped electrode, (i.e., the stripe-shaped electrodes and the radiation absorbing substance regions of the grid plate are arrayed so as to intersect perpendicularly to each other) and a spatial frequency fS of a sampling pitch, at which the latent image charges are read with scanning in the longitudinal direction of each stripe-shaped electrode, is at least two times as high as a spatial frequency fG of the grid pitch.

The term "spatial frequency fS of a sampling pitch" as used herein means the frequency represented by the formula of fS=1/PS, in which PS represents the sampling pitch.

Further, the first radiation image recording and read-out apparatus in accordance with the present invention may be constituted such that the stripe-shaped electrodes of the two-dimensional image read-out means are arrayed at a predetermined pitch so as to stand side by side in a direction, which is approximately normal to a longitudinal direction of each stripe-shaped electrode, the grid plate is constituted of radiation absorbing substance regions and radiation-permeable substance regions, which are arrayed alternately at a predetermined grid pitch so as to stand side by side in the direction approximately normal to the longitudinal direction of each stripe-shaped electrode, (i.e., the stripe-shaped electrodes and the radiation absorbing substance regions of the grid plate are arrayed in parallel with each other) and a difference between a spatial frequency fC of the pitch of the stripe-shaped electrodes and a spatial frequency fG of the grid pitch is at least 1 cycle/mm.

Furthermore, the first radiation image recording and read-out apparatus in accordance with the present invention should preferably be constituted such that the stripe-shaped electrodes of the two-dimensional image read-out means are arrayed at a predetermined pitch so as to stand side by side in a direction, which is approximately normal to a longitudinal direction of each stripe-shaped electrode, the grid plate is constituted of radiation absorbing substance regions and radiation-permeable substance regions, which are arrayed alternately at a predetermined grid pitch so as to stand side by side in the longitudinal direction of each stripe-shaped electrode, (i.e., the stripe-shaped electrodes and the radiation absorbing substance regions of the grid plate are arrayed so as to intersect perpendicularly to each other) and a difference between a spatial frequency fS of a sampling pitch, at which the latent image charges are read with scanning in the longitudinal direction of each stripe-shaped electrode, and a spatial frequency fG of the grid pitch is at least 1 cycle/mm.

The present invention further provides a second radiation image recording and read-out method, comprising the steps of:

i) locating a radiation source, which produces radiation, on one side of an object, ii) locating two-dimensional image read-out means and a radio-conductive material, which is formed on the two-dimensional image read-out means, on the other side of the object, the two-dimensional image read-out means comprising an insulating substrate and a plurality of charge collecting electrodes, which are formed in a two-dimensional pattern on the insulating substrate and each of which corresponds to a single pixel, the radio-conductive material generating electric charges carrying image information when it is exposed to radiation carrying the image information, and iii) performing an operation for recording and reading out a radiation image of the object, wherein a grid plate is located between the object and the radio-conductive material, the grid plate guiding only the radiation, which comes from a specific direction, to the radio-conductive material, and the operation for recording and reading out the radiation image of the object is performed in this state.

The present invention still further provides a second radiation image recording and read-out apparatus for carrying out the second radiation image recording and read-out method in accordance with the present invention. The second radiation image recording and read-out apparatus in accordance with the present invention is provided with the direct conversion type of solid-state radiation detector described above and will hereinbelow be referred to as the "direct conversion type of radiation image recording and read-out apparatus."

Specifically, the present invention still further provides a second radiation image recording and read-out apparatus, comprising:

i) a radiation source, which produces radiation, ii) two-dimensional image read-out means comprising an insulating substrate and a plurality of charge collecting electrodes, which are formed in a two-dimensional pattern on the insulating substrate and each of which corresponds to a single pixel, iii) a radio-conductive material, which is formed on the two-dimensional image read-out means, the radio-conductive material generating electric charges carrying image information when it is exposed to radiation carrying the image information, and iv) a grid plate, which is located between the radiation source and the radio-conductive material, the grid plate guiding only the radiation, which comes from a specific direction, to the radio-conductive material.

The second radiation image recording and read-out apparatus in accordance with the present invention should preferably be constituted such that the charge collecting electrodes of the two-dimensional image read-out means are arrayed at a predetermined pitch in an X direction and at a predetermined pitch in a Y direction, the grid plate is constituted of radiation absorbing substance regions and radiation-permeable substance regions, which are arrayed alternately at a predetermined grid pitch so as to stand side by side in at least either one of the X direction and the Y direction, and a spatial frequency fD of the charge collecting electrodes in the grid array direction is at least two times as high as a spatial frequency fG of the grid pitch.

The term "grid array direction" as used herein means the direction in which the radiation absorbing substance regions and the radiation-permeable substance regions are arrayed alternately. Also, the term "spatial frequency fD of charge collecting electrodes in a grid array direction" as used herein means the frequency represented by the formula of fD=1/PD, in which PD represents the pitch of the charge collecting electrodes in the grid pitch direction.

Also, the second radiation image recording and read-out apparatus in accordance with the present invention may be constituted such that the charge collecting electrodes of the two-dimensional image read-out means are arrayed at a predetermined pitch in an X direction and at a predetermined pitch in a Y direction, the grid plate is constituted of radiation absorbing substance regions and radiation-permeable substance regions, which are arrayed alternately at a predetermined grid pitch so as to stand side by side in at least either one of the X direction and the Y direction, and a difference between a spatial frequency fD of the charge collecting electrodes in the grid array direction and a spatial frequency fG of the grid pitch is at least 1 cycle/mm.

The present invention also provides a third radiation image recording and read-out apparatus, which is provided with the photo conversion type of solid-state radiation detector described above and will hereinbelow be referred to as the "photo conversion type of radiation image recording and read-out apparatus."

Specifically, the present invention also provides a third radiation image recording and read-out apparatus, comprising:

i) a radiation source, which produces radiation, ii) two-dimensional image read-out means comprising an insulating substrate and a plurality of photoelectric conversion devices, which are formed in a two-dimensional pattern on the insulating substrate and each of which corresponds to a single pixel, iii) a fluorescent material, which is formed on the two-dimensional image read-out means, the fluorescent material converting radiation carrying image information into visible light carrying the image information when it is exposed to the radiation carrying the image information, and iv) a grid plate, which is located between the radiation source and the fluorescent material, the grid plate guiding only the radiation, which comes from a specific direction, to the fluorescent material, wherein the photoelectric conversion devices of the two-dimensional image read-out means are arrayed at a predetermined pitch in an X direction and at a predetermined pitch in a Y direction, the grid plate is constituted of radiation absorbing substance regions and radiation-permeable substance regions, which are arrayed alternately at a predetermined grid pitch so as to stand side by side in at least either one of the X direction and the Y direction, and a spatial frequency fP of the photoelectric conversion devices in the grid array direction is at least two times as high as a spatial frequency fG of the grid pitch.

The term "spatial frequency fP of photoelectric conversion devices in a grid array direction" as used herein means the frequency represented by the formula of fP=1/PP, in which PP represents the pitch of the photoelectric conversion devices in the grid pitch direction.

The present invention further provides a fourth radiation image recording and read-out apparatus, comprising:

i) a radiation source, which produces radiation, ii) two-dimensional image read-out means comprising an insulating substrate and a plurality of photoelectric conversion devices, which are formed in a two-dimensional pattern on the insulating substrate and each of which corresponds to a single pixel, iii) a fluorescent material, which is formed on the two-dimensional image read-out means, the fluorescent material converting radiation carrying image information into visible light carrying the image information when it is exposed to the radiation carrying the image information, and iv) a grid plate, which is located between the radiation source and the fluorescent material, the grid plate guiding only the radiation, which comes from a specific direction, to the fluorescent material, wherein the photoelectric conversion devices of the two-dimensional image read-out means are arrayed at a predetermined pitch in an X direction and at a predetermined pitch in a Y direction, the grid plate is constituted of radiation absorbing substance regions and radiation-permeable substance regions, which are arrayed alternately at a predetermined grid pitch so as to stand side by side in at least either one of the X direction and the Y direction, and a difference between a spatial frequency fP of the photoelectric conversion devices in the grid array direction and a spatial frequency fG of the grid pitch is at least 1 cycle/mm.

In the third and fourth radiation image recording and read-out apparatuses in accordance with the present invention, each of the photoelectric conversion devices should preferably comprise:

a) a first thin metal film layer, which acts as a lower electrode, b) an amorphous silicon nitride insulation layer (a-$SiN_x$), which blocks passage of electrons and holes, c) a hydrogenated amorphous silicon photoelectric conversion layer (a-Si:H), d) an injection blocking layer selected from the group consisting of an n-type injection blocking layer, which blocks injection of hole carriers, and a p-type injection blocking layer, which blocks injection of electron carriers, and e) a layer selected from the group consisting of a transparent electrode layer, which acts as an upper electrode, and a second thin metal film layer, which is formed on a portion of the injection blocking layer, the layers being overlaid in this order on the insulating substrate.

The first, second, third, and fourth radiation image recording and read-out apparatuses in accordance with the present invention should preferably be provided with first image processing means for suppressing signal components SG, which are contained in an image signal having been detected by the two-dimensional image read-out means and which carry a spatial frequency fG of a grid pitch.

Also, in cases where the first, second, third, and fourth radiation image recording and read-out apparatuses in accordance with the present invention are not constituted such that a spatial frequency f0 of a sensor is at least two times as high as the spatial frequency fG of the grid pitch, they should preferably be provided with second image processing means for suppressing signal components SM, which are contained in an image signal having been detected by the two-dimensional image read-out means and which carry a moire frequency occurring due to the grid.

In the cases of the improved direct conversion type of solid-state radiation detector, the term "spatial frequency f0 of a sensor" as used herein means the spatial frequency fC of the pitch of the stripe-shaped electrodes or the spatial frequency fS of the sampling pitch. In the cases of the direct conversion type of solid-state radiation detector, the term ,spatial frequency f0 of a sensor" as used herein means the spatial frequency fD of the charge collecting electrodes in the grid array direction. In the cases of the photo conversion type of solid-state radiation detector, the term "spatial frequency f0 of a sensor" as used herein means the spatial frequency fP of the photoelectric conversion devices in the grid array direction.

In cases where the grid pitch PG and a sensor pitch P0 are different from each other, even if uniform radiation is irradiated, a periodical striped pattern, i.e. a moire, occurs in the image due to a spatial phase difference. The term "moire frequency occurring due to a grid" as used herein means the repetition frequency of the striped pattern in the moire phenomenon. Specifically, in the cases of the improved direct conversion type of radiation image recording and read-out apparatus, the term "moire frequency occurring due to a grid" as used herein means the difference between the spatial frequency fC of the pitch of the stripe-shaped electrodes and the spatial frequency fG of the grid pitch, or the difference between the spatial frequency fS of the sampling pitch, at which the latent image charges are read with scanning in the longitudinal direction of each stripe-shaped electrode, and the spatial frequency fG of the grid pitch. In the cases of the direct conversion type of radiation image recording and read-out apparatus, the term "moire frequency occurring due to a grid" as used herein means the difference between the spatial frequency fD of the charge collecting electrodes in the grid array direction and the spatial frequency fG of the grid pitch. In the cases of the photo conversion type of radiation image recording and read-out apparatus, the term "moire frequency occurring due to a grid" as used herein means the difference between the spatial frequency fP of the photoelectric conversion devices in the grid array direction and the spatial frequency fG of the grid pitch.

In the cases of the improved direct conversion type of solid-state radiation detector, the term "sensor pitch P0" as used herein means the pitch PC of the stripe-shaped electrodes or the sampling pitch PS. In the cases of the direct conversion type of solid-state radiation detector, the term "sensor pitch P0" as used herein means the pitch PD of the charge collecting electrodes in the grid pitch direction. In the cases of the photo conversion type of solid-state radiation detector, the term "sensor pitch P0" as used herein means the pitch PP of the photoelectric conversion devices in the grid pitch direction.

Further, the radiation image recording and read-out apparatuses in accordance with the present invention should preferably be constituted such that the apparatuses further comprise an analog-to-digital converter for converting the image signal, which has been detected by the two-dimensional image read-out means, into a digital image signal, and the first image processing means performs processing for suppressing the signal components SG, which carry the spatial frequency fG of the grid pitch, on the digital image signal, or the second image processing means performs processing for suppressing the signal components SM, which carry the moire frequency occurring due to the grid, on the digital image signal.

With the first radiation image recording and read-out method and the first radiation image recording and read-out apparatus in accordance with the present invention, which are of the improved direct conversion type, the grid plate is located between the radiation source and the two-dimensional image read-out means, the grid plate guiding only the radiation, which comes from a specific direction, to the two-dimensional image read-out means. Therefore, the radiation scattered in the object is absorbed by the radiation absorbing substance regions of the grid plate. As a result, the problems can be prevented from occurring in that the image quality becomes bad due to the scattered radiation.

With the second radiation image recording and read-out method and the second radiation image recording and read-out apparatus in accordance with the present invention, which are of the direct conversion type, the grid plate is located between the radiation source and the radio-conductive material, the grid plate guiding only the radiation, which comes from a specific direction, to the radio-conductive material. Therefore, as in the first radiation image recording and read-out method and the first radiation image recording and read-out apparatus in accordance with the present invention, the problems can be prevented from occurring in that the image quality becomes bad due to the scattered radiation.

With all of the radiation image recording and read-out apparatuses in accordance with the present invention, in cases where the spatial frequency f0 of the sensor is at least two times as high as the spatial frequency fG of the grid pitch, the striped pattern occurring in the image due to the moire phenomenon can be rendered imperceptible in accordance with the so-called "sampling theorem."

Also, in cases where the signal components SG, which are contained in the image signal having been detected by the two-dimensional image read-out means and which carry the spatial frequency fG of the grid pitch, are suppressed, the grid pattern occurring in the image can be rendered visually imperceptible.

Also, with all of the radiation image recording and read-out apparatuses in accordance with the present invention, in cases where they are not constituted such that the spatial frequency f0 of the sensor is at least two times as high as the spatial frequency fG of the grid pitch, the moire frequency may be rendered to be at least 1 cycle/mm, and the number of stripes periodically occurring in the image due to the moire phenomenon may thereby be decreased. In this manner, the striped pattern can be rendered visually imperceptible.

In cases where the first, second, third, and fourth radiation image recording and read-out apparatuses in accordance with the present invention are not constituted such that the spatial frequency f0 of the sensor is at least two times as high as the spatial frequency fG of the grid pitch, the signal components SM, which are contained in the image signal having been detected by the two-dimensional image read-out means and which carry the moire frequency occurring due to the grid, may be suppressed. In this manner, the moire occurring in the image can be rendered visually imperceptible. In such cases, there is no risk that the important components of at most 1 cycle/mm, which are contained in the image information, are lost.

With the third and fourth radiation image recording and read-out apparatuses in accordance with the present invention, which are of the photo conversion type, each of the photoelectric conversion devices may comprise:

a) the first thin metal film layer, which acts as the lower electrode, b) the amorphous silicon nitride insulation layer (a-$SiN_x$), which blocks passage of electrons and holes, c) the hydrogenated amorphous silicon photoelectric conversion layer (a-Si:H), d) the injection blocking layer selected from the group consisting of the n-type injection blocking layer, which blocks injection of hole carriers, and the p-type injection blocking layer, which blocks injection of electron carriers, and e) the layer selected from the group consisting of the transparent electrode layer, which acts as the upper electrode, and the second thin metal film layer, which is formed on a portion of the injection blocking layer, the layers being overlaid in this order on the insulating substrate.

In such cases, the two-dimensional image read-out means having a large area and high performance can be produced with an ordinary thin film forming apparatus, such as a chemical vapor deposition (CVD) apparatus or a sputtering apparatus. Also, the two-dimensional-image read-out means can be produced with a small number of simple processes, at a high yield, and at a low cost.

DESCRIPTION OF THE PREFERRED EMBODIMENTS

The present invention will hereinbelow be described in further detail with reference to the accompanying drawings.

Firstly, embodiments of the improved direct conversion type of radiation image recording and read-out apparatus in accordance with the present invention will be described hereinbelow.

Figure 1A:
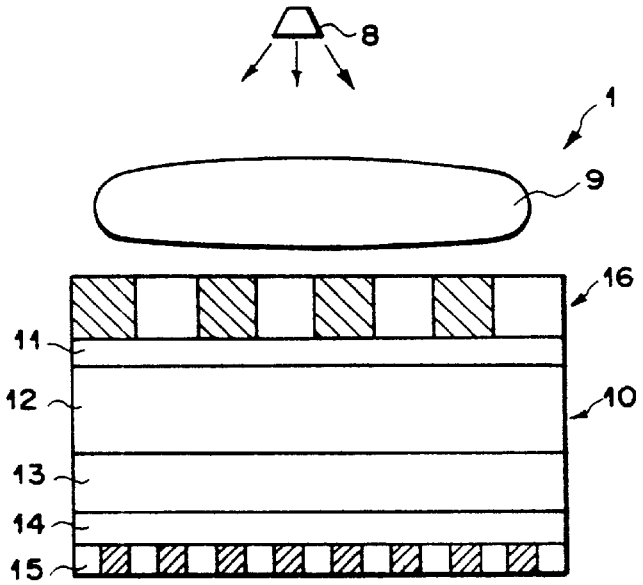
FIG. 1A is a schematic view showing an embodiment of the improved direct conversion type of radiation image recording and read-out apparatus in accordance with the present invention.

FIG. 1A is a schematic view showing an embodiment of the improved direct conversion type of radiation image recording and read-out apparatus in accordance with the present invention. As illustrated in FIG. 1A, an improved direct conversion type of radiation image recording and read-out apparatus 1 comprises a radiation source 8, which produces radiation, an improved direct conversion type of solid-state radiation detector 10, which acts as two-dimensional image read-out means, and a grid plate 16, which is located between the radiation source 8 and the two-dimensional image read-out means. The grid plate 16 guides only the radiation, which comes from a specific direction, to the two-dimensional image read-out means.

The improved direct conversion type of solid-state radiation detector 10 comprises a first electrical conductor layer 11 having permeability to recording radiation, and a recording photo-conductive layer 12, which exhibits photo-conductivity when it is exposed to the recording radiation having passed through the first electrical conductor layer. The solid-state radiation detector 10 also comprises a charge transporting layer 13, which acts approximately as an insulator with respect to electric charges having a polarity identical with the polarity of electric charges occurring in the first electrical conductor layer 11, and which acts approximately as a conductor with respect to electric charges having a polarity opposite to the polarity of the electric charges occurring in the first electrical conductor layer 11. The solid-state radiation detector 10 further comprises a reading photo-conductive layer 14, which exhibits photo-conductivity when it is exposed to a reading electromagnetic wave, and a second electrical conductor layer 15 having permeability to the reading electromagnetic wave. The layers 11, 12, 13, 14, and 15 are overlaid in this order.

Figure 1B:
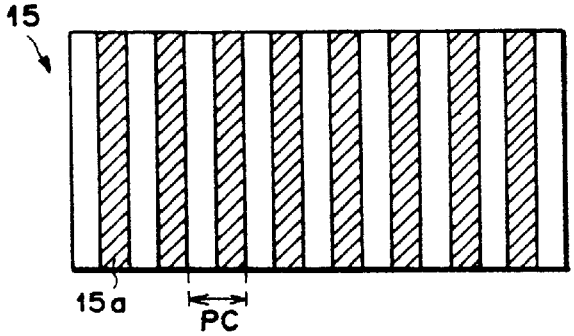
FIG. 1B is a plan view showing a solid-state radiation detector in the embodiment of FIG. 1A, as viewed from the side of a second electrical conductor layer.

FIG. 1B is a plan view showing the solid-state radiation detector 10, as viewed from the side of the second electrical conductor layer 15. As indicated by the hatching in FIG. 1B, the second electrical conductor layer 15 is constituted as stripe-shaped electrodes 15*a*, 15*a*, . . . having comb tooth-like shapes. The stripe-shaped electrodes 15*a*, 15*a*, . . . are arrayed at a predetermined pitch PC (mm) so as to stand side by side in a direction, which is approximately normal to a longitudinal direction of each stripe-shaped electrode 15*a*.

Figure 1C:
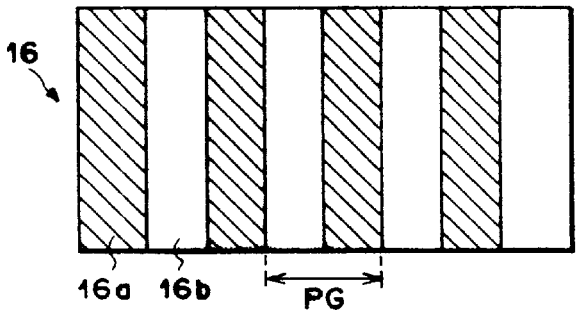
FIG. 1C is a plan view showing the solid-state radiation detector in the embodiment of FIG. 1A, as viewed from the side of a grid plate.

FIG. 1C is a plan view showing the solid-state radiation detector 10, as viewed from the side of the grid plate 16. The grid plate 16 is constituted of radiation absorbing substance regions 16*a*, 16*a*, . . . (formed from lead, or the like) and radiation-permeable substance regions 16*b*, 16*b*, . . . (formed from aluminum, or the like), which are arrayed alternately at a predetermined grid pitch PG (mm) so as to stand side by side in the direction approximately normal to the longitudinal direction of each stripe-shaped electrode 15*a*. Specifically, the stripe-shaped electrodes 15*a*, 15*a*, . . . and the radiation absorbing substance regions 16*a*, 16*a*, . . . of the grid plate 16 are arrayed in parallel with each other. Also, the radiation-permeable substance regions 16*b*, 16*b*, . . . of the grid plate 16 are arrayed in parallel with the stripe-shaped electrodes 15*a*, 15*a*, . . .

With the radiation image recording and read-out apparatus 1, a radiation image is recorded with the solid-state radiation detector 10 and read out in the manner described below. Specifically, firstly, a D.C. voltage is applied across the first electrical conductor layer 11 and the stripe-shaped electrodes 15*a*, 15*a*, . . . of the second electrical conductor layer 15, and the two electrical conductor layers are electrically charged. The solid-state radiation detector 10 is located such that the surface on the side of the first electrical conductor layer 11 may stand facing the radiation source 8, and radiation carrying image information of an object 9 is irradiated to the first electrical conductor layer 11. The radiation, which has passed through the first electrical conductor layer 11, impinges upon the recording photoconductive layer 12. As a result, electric charge pairs of electrons (negative charges) and holes (positive charges) occur in the recording photo-conductive layer 12. The negative charges or the positive charges are accumulated as latent image charges, which carry the radiation image information, at the interface between the recording photoconductive layer 12 and the charge transporting layer 13. Thereafter, the stripe-shaped electrodes 15*a*, 15*a*, . . . are scanned with a (line-like) reading electromagnetic wave along the longitudinal direction of each stripe-shaped electrode 15*a*. As a result, electric charge pairs of electrons (negative charges) and holes (positive charges) occur in the reading photoconductive layer 14. Also, electric charges (transported polarity charges) having the polarity opposite to the polarity of the latent image charges move through the charge transporting layer 13 toward the recording photoconductive layer 12. When the transported polarity charges arrive at the interface between the recording photoconductive layer 12 and the charge transporting layer 13, charge recombination occurs between the accumulated latent image charges and the transported polarity charges. As a result, an electric current in accordance with the latent image charges flows. The electric current occurring from the charge recombination is detected by a signal processing circuit (not shown), and an image signal is thereby obtained. A signal detected from the respective stripe-shaped electrodes 15*a*, 15*a*, . . . is the signal in the main scanning direction. The scanning with the (line-like) reading electromagnetic wave in the longitudinal direction of each stripe-shaped electrode 15a corresponds to the sub-scanning.

The radiation, which has been produced by the radiation source 8, is irradiated to the object 9 (such as a human body). At this time, absorption, scattering, and passage of the radiation occur in accordance with substances contained in the object 9, and the radiation carrying image information of the object 9 travels toward the grid plate 16. The grid plate 16 acts to prevent image information from becoming bad due to the scattered radiation. Specifically, only the radiation traveling in a specific direction (in this case, in the cross-sectional direction of the grid plate 16) passes through the radiation-permeable substance regions 16*b*, 16*b*, . . . , and the radiation scattered in the object 9 is absorbed by the radiation absorbing substance regions 16*a*, 16*a*, . . . Therefore, the problems concerning the image quality do not occur in that signal components corresponding to the scattered radiation mix in the image signal representing the image information of the object 9 and therefore a high signal-to-noise ratio cannot be obtained or the resolution cannot be kept high.

In cases where the spatial frequency fC of the pitch of the stripe-shaped electrodes 15*a*, 15*a*, . . . , which is represented by the formula of fC=1/PC (cycle/mm), is set to be at least two times as high as the spatial frequency fG of the grid pitch, which is represented by the formula of fG=1/PG (cycle/mm), as will be estimated from the sampling theorem, a moire phenomenon forming a periodical (perceptible) striped pattern in the image does not occur theoretically. In such cases, signal components representing the pattern of the grid plate 16 are detected. Therefore, an image pattern representing the grid plate 16 is superposed upon the object image, and the object image becomes hard to see.

Accordingly, such that the signal components representing the pattern of the grid plate 16 may be eliminated, the signal components SG, which are contained in the image signal having been detected by the two-dimensional image read-out means (in this embodiment, the solid-state radiation detector 10) and which carry the spatial frequency fG of the grid pitch, are suppressed. In this manner, the grid pattern occurring in the image can be rendered visually imperceptible.

Figure 2A:
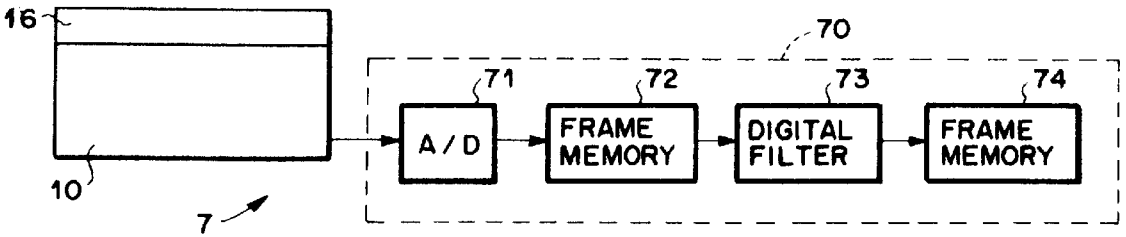
FIG. 2A is a block diagram showing an embodiment of the radiation image recording and read-out apparatus provided with image processing means.

FIG. 2A is a block diagram showing a radiation image recording and read-out apparatus 7 provided with image processing means 70 for eliminating the signal components representing the pattern of the grid plate 16.

As illustrated in FIG. 2A, the radiation image recording and read-out apparatus 7 comprises the radiation image recording and read-out apparatus 1 described above and the image processing means 70 connected to the radiation image recording and read-out apparatus 1. The image processing means 70 comprises an analog-to-digital converter 71 for converting an analog output signal, which has been obtained from the solid-state radiation detector 10, into a digital signal, and a frame memory 72 for storing the digital signal. The image processing means 70 also comprises a digital filter 73 for suppressing the signal components SG, which are contained in the signal received from the frame memory 72 and which carry the spatial frequency fG of the grid pitch. The image processing means 70 further comprises a frame memory 74 for storing an output signal obtained from the digital filter 73.

Figure 2B:
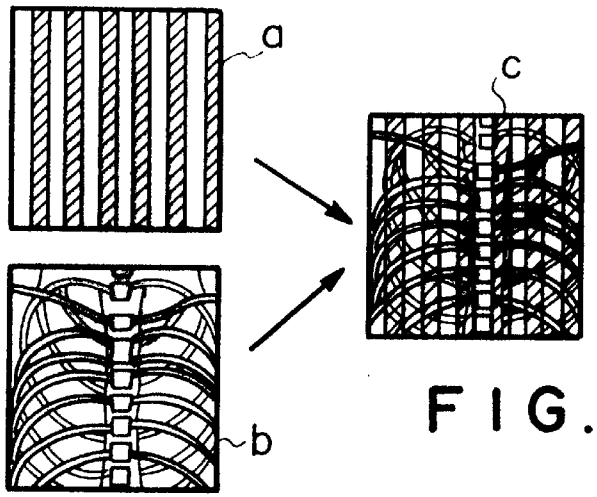
FIG. 2B is an explanatory view showing an image represented by an output signal obtained from two-dimensional image read-out means.

With the radiation image recording and read-out apparatus 7, the output signal obtained from the solid-state radiation detector 10 is stored in the frame memory 72. The output signal contains the signal components representing the pattern of the grid plate 16. If an image is reproduced from the output signal, an image "c" shown in FIG. 2B will be obtained. As illustrated in FIG. 2B, in the image "c," an image "a" of a vertical stripe patterns representing the grid plate 16 and standing side by side in the main scanning direction is superposed upon an object image "b."

Figure 2C:
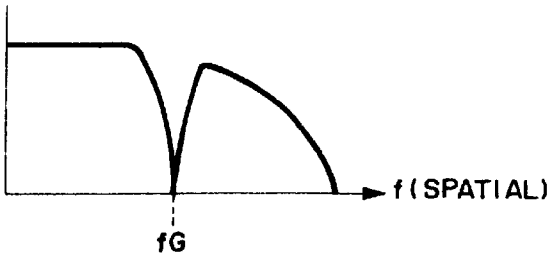
FIG. 2C is a graph showing an example of characteristics of a filter for suppressing signal components, which carry a spatial frequency of a grid pitch.

The digital filter 73 suppresses the signal components representing the striped image "a" of the grid plate 16, i.e. the signal components SG carrying the spatial frequency fG of the grid pitch. FIG. 2C shows an example of amplitude characteristics of the digital filter 73. Since the signal components SG carrying the spatial frequency fG of the grid pitch have been suppressed by the digital filter 73, the output signal obtained from the digital filter 73 contains approximately only the signal representing the object image "b" shown in FIG. 2B. The thus obtained signal is stored in the frame memory 74, and the stored signal is read when it is to be used for making a diagnosis, or the like.

In this embodiment, as the means for suppressing the signal components SG carrying the spatial frequency fG of the grid pitch, the digital filter 73 is employed. Alternatively, an analog filter may be employed for such purposes. Specifically, in the embodiment described above, the radiation absorbing substance regions 16*a*, 16*a*, . . . and the radiation-permeable substance regions 16*b*, 16*b*, . . . of the grid plate 16 are arrayed so as to stand side by side in the main scanning direction. Therefore, a simple trap (a band elimination filter) for suppressing the signal components SG carrying the spatial frequency fG of the grid pitch may be employed.

In cases where the spatial frequency fG of the grid pitch cannot be set so as to satisfy the relationship described above, the difference between the spatial frequency fC of the pitch of the stripe-shaped electrodes 15*a*, 15*a*, . . . , which is represented by the formula of fC=1/PC (cycle/mm), and the spatial frequency fG of the grid pitch, which is represented by the formula of fG=1/PG (cycle/mm), the difference representing the moire frequency, may be set to be at least 1 cycle/mm. In this manner, the number of stripes periodically occurring in the image due to the moire phenomenon can be decreased, and the striped pattern can be rendered visually imperceptible.

In such cases, the signal components SM, which are contained in the image signal having been detected by the two-dimensional image read-out means (in this embodiment, the solid-state radiation detector 10) and which carry the moire frequency occurring due to the grid plate 16, may be suppressed. In this manner, the moire occurring in the image can be rendered visually imperceptible. In such cases, there is no risk that the important components of at most 1 cycle/mm, which are contained in the image information, are lost.

Figure 2D:
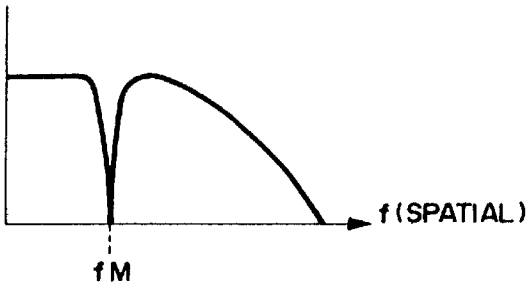
FIG. 2D is a graph showing an example of characteristics of a filter for suppressing signal components, which carry a moire frequency occurring due to the grid plate.

For such purposes, for example, the digital filter 73 of the image processing means 70 shown in FIG. 2A may be set so as to suppress the signal components SM carrying the moire frequency occurring due to the grid plate 16. FIG. 2D shows an example of amplitude characteristics of the digital filter 73 which is set for such purposes.

Figure 3A:
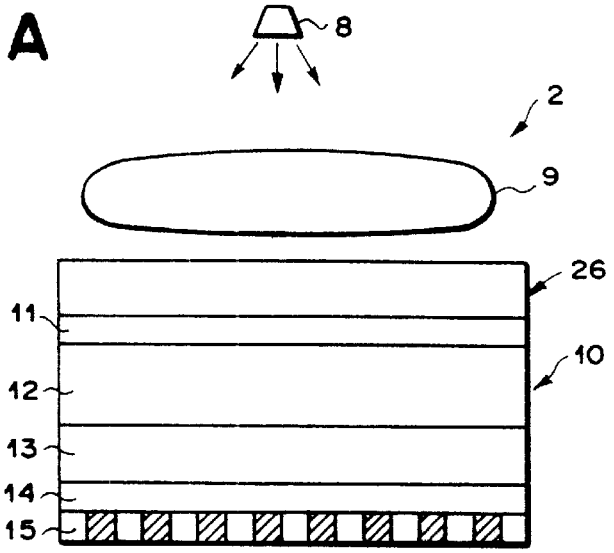
FIG. 3A is a schematic view showing an embodiment of the improved direct conversion type of radiation image recording and read-out apparatus in accordance with the present invention, in which a grid array direction is different from that in the embodiment of FIG. 1A.

A different embodiment of the improved direct conversion type of radiation image recording and read-out apparatus in accordance with the present invention will be described hereinbelow with reference to FIGS. 3A, 3B, and 3C. As illustrated in FIG. 3A, in an improved direct conversion type of radiation image recording and read-out apparatus 2, a grid plate 26 comprises radiation absorbing substance regions 26*a*, 26*a*, . . . and radiation-permeable substance regions 26*b*, 26*b*, . . . , which are arrayed alternately so as to stand side by side in the longitudinal direction of each stripe-shaped electrode 15*a*.

FIG. 3A is a schematic view showing the improved direct conversion type of radiation image recording and read-out apparatus 2. As illustrated in FIG. 3A, basically, the radiation image recording and read-out apparatus 2 has the same constitution as that in the radiation image recording and read-out apparatus 1 described above, except that the grid array direction of the grid plate is varied.

Figure 3B:
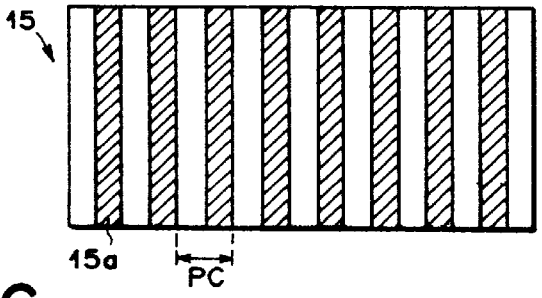
FIG. 3B is a plan view showing a solid-state radiation detector in the embodiment of FIG. 3A, as viewed from the side of a second electrical conductor layer.

FIG. 3B is a plan view showing the solid-state radiation detector 10 in the embodiment of FIG. 3A, as viewed from the side of the second electrical conductor layer 15. The second electrical conductor layer 15 is constituted as stripe-shaped electrodes 15*a*, 15*a*, . . . having comb tooth-like shapes. The stripe-shaped electrodes 15*a*, 15*a*, . . . are arrayed at the predetermined pitch PC (mm) so as to stand side by side in the direction, which is approximately normal to the longitudinal direction of each stripe-shaped electrode 15*a*.

Figure 3C:
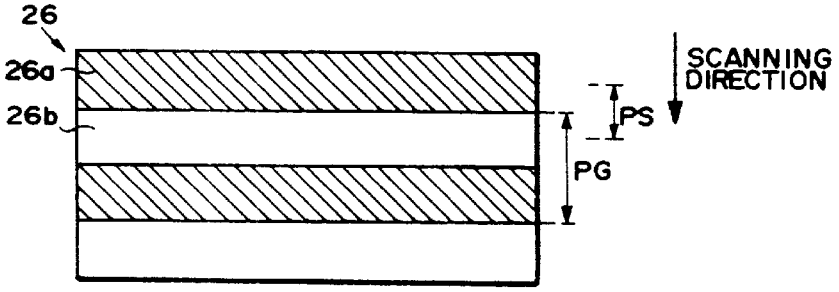
FIG. 3C is a plan view showing the solid-state radiation detector in the embodiment of FIG. 3A, as viewed from the side of a grid plate.

FIG. 3C is a plan view showing the solid-state radiation detector 10 in the embodiment of FIG. 3A, as viewed from the side of the grid plate 26. The grid plate 26 is constituted of the radiation absorbing substance regions 26*a*, 26*a*, . . . and the radiation-permeable substance regions 26*b*, 26*b*, . . . , which are arrayed alternately at the predetermined grid pitch PG (mm) so as to stand side by side in the longitudinal direction of each stripe-shaped electrode 15*a*. Specifically, the stripe-shaped electrodes 15*a*, 15*a*, . . . and the radiation absorbing substance regions 26*a*, 26*a*, . . . of the grid plate 26 are arrayed so as to intersect perpendicularly to each other. Also, the radiation-permeable substance regions 26*b*, 26*b*, . . . of the grid plate 26 are arrayed so as to intersect perpendicularly to the stripe-shaped electrodes 15*a*, 15*a*, . . .

With the radiation image recording and read-out apparatus 2, a radiation image is recorded with the solid-state radiation detector 10 and read out in the same manner as that in the radiation image recording and read-out apparatus 1 described above.

With the radiation image recording and read-out apparatus 2, wherein the grid plate 26 is employed, the problems concerning the deterioration of the image quality due to the scattered radiation can be eliminated.

In cases where the spatial frequency fS of a sampling pitch, at which the latent image charges are read with scanning in the longitudinal direction of each stripe-shaped electrode 15*a*, which is represented by the formula of fS=1/PS (cycle/mm), is set to be at least two times as high as the spatial frequency fG of the grid pitch, which is represented by the formula of fG=1/PG (cycle/mm), as will be estimated from the sampling theorem, a moire phenomenon forming a periodical (perceptible) striped pattern in the image does not occur theoretically.

In cases where the spatial frequency fG of the grid pitch cannot be set so as to satisfy the relationship described above, the difference between the spatial frequency fS of the sampling pitch, at which the latent image charges are read with scanning in the longitudinal direction of each stripe-shaped electrode 15*a*, which is represented by the formula of fS=1/PS (cycle/mm), and the spatial frequency fG of the grid pitch, which is represented by the formula of fG=1/PG (cycle/mm), the difference representing the moire frequency, may be set to be at least 1 cycle/mm. In this manner, the number of stripes periodically occurring in the image due to the moire phenomenon can be decreased, and the striped pattern can be rendered visually imperceptible.

In the embodiment of FIG. 3A, as described above with reference to FIGS. 2A, 2B, 2C, and 2D, the radiation image recording and read-out apparatus 2 may be provided with the image processing means for suppressing the signal components SG, which are contained in the image signal having been detected by the solid-state radiation detector 10 and which carry the spatial frequency fG of the grid pitch, or the image processing means for suppressing the signal components SM, which are contained in the image signal having been detected by the solid-state radiation detector 10 and which carry the moire frequency occurring due to the grid plate 26. In this manner, the grid pattern occurring in the image or the moire occurring in the image can be rendered visually imperceptible.

Figure 4:
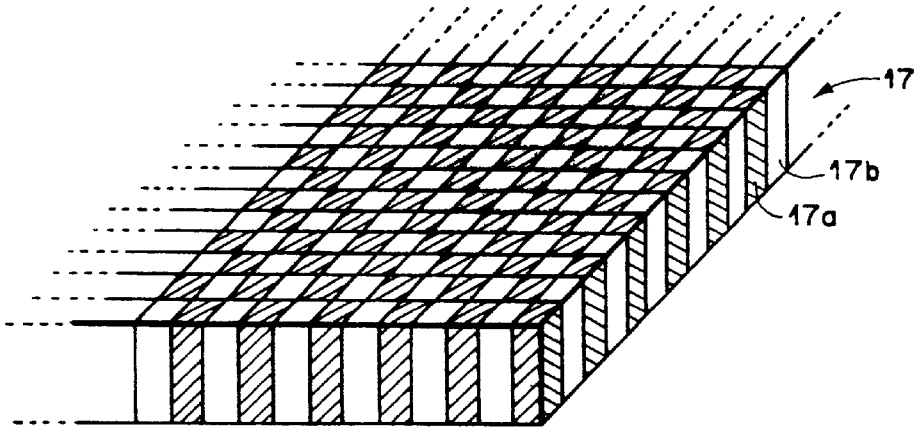
FIG. 4 is a perspective view showing an example of a grid plate having a checkered pattern.

In the radiation image recording and read-out apparatuses 1 and 2 described above, the radiation absorbing substance regions and the radiation-permeable substance regions of the grid plate are arrayed in one direction. However, in the improved direct conversion type of radiation image recording and read-out apparatus in accordance with the present invention, the grid array direction is not limited to one direction. Specifically, the improved direct conversion type of radiation image recording and read-out apparatus in accordance with the present invention reads out a two-dimensional image. Therefore, as illustrated in FIG. 4, a checkered grid plate 17 comprising radiation absorbing substance regions 17*a*, 17*a*, . . . and radiation-permeable substance regions 17*b*, 17*b*, . . . , which are arrayed in a two-dimensional pattern, may be employed. In the grid plate 17, the radiation absorbing substance regions 17*a*, 17*a*, . . . and the radiation-permeable substance regions 17*b*, 17*b*, . . . are arrayed alternately such that they may stand side by side in the longitudinal direction of each stripe-shaped electrode 15*a* and in the direction approximately normal to the longitudinal direction. In cases where the grid plate 17 is employed, the effects of the improved direct conversion type of radiation image recording and read-out apparatus in accordance with the present invention can be obtained with respect to both the longitudinal direction of each stripe-shaped electrode 15*a* and the direction approximately normal to the longitudinal direction.

In the embodiments described above, the solid-state radiation detector 10 comprises the first electrical conductor layer 11 having permeability to recording radiation, the recording photo-conductive layer 12, which exhibits photo-conductivity when it is exposed to the recording radiation having passed through the first electrical conductor layer, the charge transporting layer 13, which acts approximately as an insulator with respect to electric charges having a polarity identical with the polarity of electric charges occurring in the first electrical conductor layer 11, and which acts approximately as a conductor with respect to electric charges having a polarity opposite to the polarity of the electric charges occurring in the first electrical conductor layer 11, the reading photo-conductive layer 14, which exhibits photo-conductivity when it is exposed to a reading electromagnetic wave, and the second electrical conductor layer 15 having permeability to the reading electromagnetic wave, the layers 11, 12, 13, 14, and 15 being overlaid in this order. However, the two-dimensional image read-out means is not limited to the solid-state radiation detector 10 described above and may be one of various other means constituted such that the latent image charges carrying image information can be read with stripe-shaped electrodes.

Also, in the radiation image recording and read-out apparatuses 1 and 2 described above, the second electrical conductor layer 15 is constituted of the stripe-shaped electrodes 15*a*, 15*a*, . . . Alternatively, the second electrical conductor layer 15 may be formed as a flat plate-like layer and may be scanned with spot-like reading light, such as a laser beam, for reading the latent image charges. In such cases, the spatial frequency fS of the sampling pitch, at which the latent image charges are read with scanning with the reading light, may be set to be at least two times as high as the spatial frequency fG of the grid pitch. In this manner, a moire phenomenon forming a periodical (perceptible) striped pattern in the image does not occur. Also, the difference between the spatial frequency fS of the sampling pitch and the spatial frequency fG of the grid pitch, the difference representing the moire frequency, may be set to be at least 1 cycle/mm. In this manner, the number of stripes periodically occurring in the image due to the moire phenomenon can be decreased, and the striped pattern can be rendered visually imperceptible. The spatial frequency fS of the sampling pitch may be of either one or both of the main scanning direction and the sub-scanning direction.

An embodiment of the direct conversion type of radiation image recording and read-out apparatus in accordance with the present invention will be described hereinbelow with reference to FIG. 5.

Figure 5:
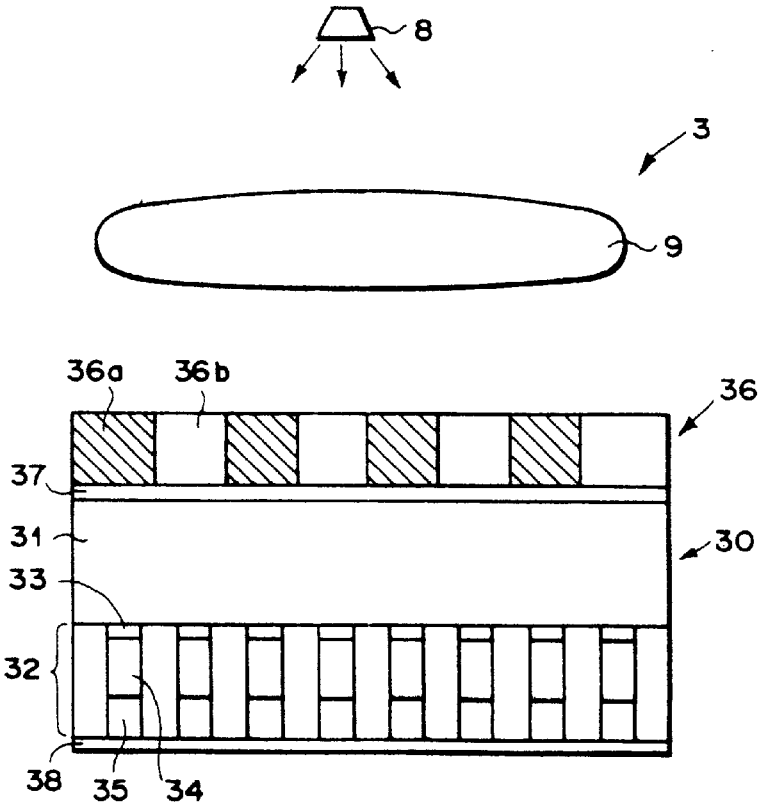
FIG. 5 is a schematic view showing an embodiment of the direct conversion type of radiation image recording and read-out apparatus in accordance with the present invention.

FIG. 5 is a schematic view showing a direct conversion type of radiation image recording and read-out apparatus 3 in accordance with the present invention, which is provided with a solid-state radiation detector 30. As illustrated in FIG. 5, the direct conversion type of radiation image recording and read-out apparatus 3 comprises the radiation source 8, which produces radiation, the direct conversion type of solid-state radiation detector 30, and a grid plate 36, which is located between the radiation source 8 and a radio-conductive material 31 of the solid-state radiation detector 30. The grid plate 36 guides only the radiation, which comes from a specific direction, to the radio-conductive material 31.

The solid-state radiation detector 30 is provided with two-dimensional image read-out means 32. The two-dimensional image read-out means 32 comprises an insulating substrate (not shown), which is formed from, for example, quartz glass having a thickness of 3 mm, and a plurality of charge collecting electrodes 33, 33, . . . , which are formed on the insulating substrate and each of which corresponds to a single pixel. The charge collecting electrodes 33, 33, . . . are arrayed at a predetermined pitch PD (mm) in a matrix-like pattern in an X direction and a Y direction. The two-dimensional image read-out means 32 also comprises capacitors 34, 34, . . . Each of the capacitors 34, 34, . . . accumulates signal charges, which have been collected by the corresponding charge collecting electrode 33, as latent image charges. The two-dimensional image read-out means 32 further comprises switching devices 35, 35, . . . , which may be constituted of TFT's, or the like. Each of the switching devices 35, 35, . . . transfers the latent image charges, which have been accumulated by the corresponding capacitor 34, to the side of a signal processing circuit. The two-dimensional image read-out means 32 still further comprises a plurality of signal lines and scanning lines (not shown), which are connected to the switching devices 35, 35, . . . and are formed in a matrix-like pattern so as to intersect perpendicularly to each other.

A first electrode 37 is formed on the side of the upper surface of the radio-conductive material 31. A second electrode 38 is formed on the side of the lower surfaces of the switching devices 35, 35, . . .

The grid plate 36 is constituted of radiation absorbing substance regions 36*a*, 36*a*, . . . and radiation-permeable substance regions 36*b*, 36*b*, . . . , which are arrayed alternately at a predetermined grid pitch PG (mm) so as to stand side by side in at least either one of the X direction and the Y direction. (In FIG. 5, the grid array in only one specific direction is shown.)

With the radiation image recording and read-out apparatus 3, a radiation image is recorded with the solid-state radiation detector 30 and read out in the manner described below. Specifically, firstly, a D.C. voltage is applied across the first electrode 37 and the second electrode 38, and the two electrodes are electrically charged. The solid-state radiation detector 30 is located such that the surface on the side of the radio-conductive material 31 may stand facing the side of the radiation source 8, and radiation carrying image information of the object 9 is irradiated to the radio-conductive material 31. As a result, electric charge pairs of electrons (negative charges) and holes (positive charges) occur in the radio-conductive material 31. The negative charges or the positive charges are collected by the charge collecting electrodes 33, 33, . . . and are accumulated as latent image charges, which carry the radiation image information, by the capacitors 34, 34, . . . The latent image charges are transferred by the switching devices 35, 35, . . . , which are located so as to correspond to the charge collecting electrodes 33, 33,. . . , to the signal processing circuit (not shown) and are outputted as an image signal.

With the radiation image recording and read-out apparatus 3, wherein the grid plate 36 is employed, as in the improved direct conversion types of radiation image recording and read-out apparatuses 1 and 2 described above, the problems concerning the deterioration of the image quality due to the scattered radiation can be eliminated.

In cases where the spatial frequency fD of the charge collecting electrodes 33, 33, . . . in the grid array direction, which is represented by the formula of fD=1/PD (cycle/mm), is set to be at least two times as high as the spatial frequency fG of the grid pitch, which is represented by the formula of fG=1/PG (cycle/mm), as in the improved direct conversion types of radiation image recording and read-out apparatuses 1 and 2 described above, a moire phenomenon forming a periodical (perceptible) striped pattern in the image does not occur theoretically.

In cases where the spatial frequency fG of the grid pitch cannot be set so as to satisfy the relationship described above, the difference between the spatial frequency fD of the charge collecting electrodes 33, 33, . . . in the grid array direction, which is represented by the formula of fD=1/PD (cycle/mm), and the spatial frequency fG of the grid pitch, which is represented by the formula of fG=1/PG (cycle/mm), the difference representing the moire frequency, may be set to be at least 1 cycle/mm. In this manner, the number of stripes periodically occurring in the image due to the moire phenomenon can be decreased, and the striped pattern can be rendered visually imperceptible.

In the embodiment of FIG. 5, as described above with reference to FIGS. 2A, 2B, 2C, and 2D, the radiation image recording and read-out apparatus 3 may be provided with the image processing means for suppressing the signal components SG, which are contained in the image signal having been detected by the two-dimensional image read-out means 32 and which carry the spatial frequency fG of the grid pitch, or the image processing means for suppressing the signal components SM, which are contained in the image signal having been detected by the two-dimensional image read-out means 32 and which carry the moire frequency occurring due to the grid plate 36. In this manner, the grid pattern occurring in the image or the moire occurring in the image can be rendered visually imperceptible.

In FIG. 5, the specific cross-section of the solid-state radiation detector 30 of the radiation image recording and read-out apparatus 3 is illustrated, and the grid plate 36 is illustrated so as to comprise the radiation absorbing substance regions 36*a*, 36*a*, . . . and the radiation-permeable substance regions 36*b*, 36*b*, . . . , which are arrayed alternately so as to stand side by side in either one of the X direction and the Y direction. However, in the direct conversion type of radiation image recording and read-out apparatus in accordance with the present invention, the grid array direction is not limited to one direction. Specifically, the direct conversion type of radiation image recording and read-out apparatus in accordance with the a present invention reads out a two-dimensional image. Therefore, as illustrated in FIG. 4, the checkered grid plate 17 comprising the radiation absorbing substance regions 17*a*, 17*a*, . . . and the radiation-permeable substance regions 17*b*, 17*b*, . . . , which are arrayed in a two-dimensional pattern, may be employed. In the grid plate 17, the radiation absorbing substance regions 17*a*, 17*a*, . . . and the radiation-permeable substance regions 17*b*, 17*b*, . . . are arrayed alternately such that they may stand side by side in the X direction and in the Y direction. In cases where the grid plate 17 is employed, the effects of the direct conversion type of radiation image recording and read-out apparatus in accordance with the present invention can be obtained with respect to both the X direction and the Y direction.

An embodiment of the photo conversion type of radiation image recording and read-out apparatus in accordance with the present invention will be described hereinbelow with reference to FIG. 6.

Figure 6:
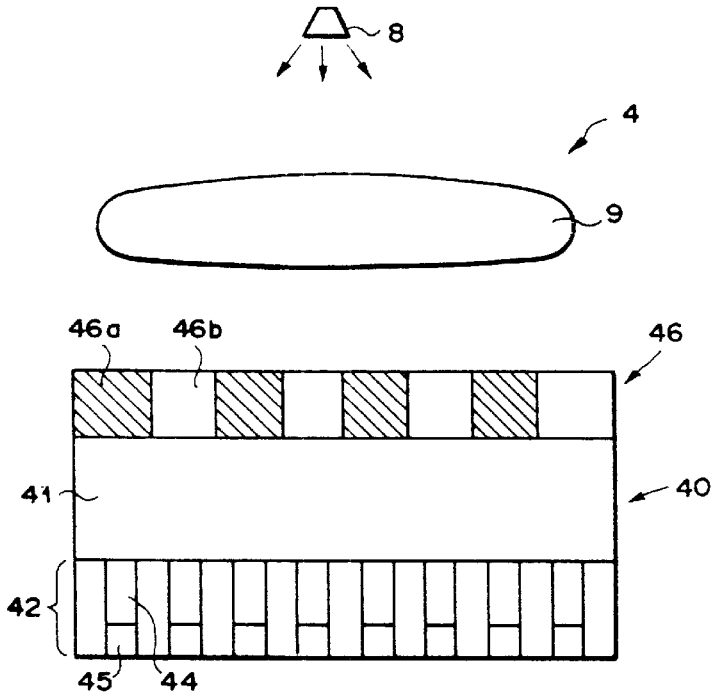
FIG. 6 is a schematic view showing an embodiment of the photo conversion type of radiation image recording and read-out apparatus in accordance with the present invention.

FIG. 6 is a schematic view showing a photo conversion type of radiation image recording and read-out apparatus 4 in accordance with the present invention, which is provided with a solid-state radiation detector 40. As illustrated in FIG. 6, the photo conversion type of radiation image recording and read-out apparatus 4 comprises the radiation source 8, which produces radiation, the photo conversion type of solid-state radiation detector 40, and a grid plate 46, which is located between the radiation source 8 and a fluorescent material (i.e., a scintillator 41) of the solid-state radiation detector 40. The grid plate 46 guides only the radiation, which comes from a specific direction, to the scintillator 41.

The photo conversion type of solid-state radiation detector 40 is provided with two-dimensional image read-out means 42. The two-dimensional image read-out means 42 comprises an insulating substrate (not shown), which is formed from, for example, quartz glass having a thickness of 3 mm, and a plurality of photoelectric conversion devices 44, 44, . . . , which are formed on the insulating substrate and each of which corresponds to a single pixel. The photoelectric conversion devices 44, 44, . . . are arrayed at a predetermined pitch PD (mm) in a matrix-like pattern in an X direction and a Y direction. The two-dimensional image read-out means 42 also comprises switching devices 45, 45, . . . , which may be constituted of TFT's, or the like. Each of the switching devices 45, 45, . . . transfers signal charges, which have been obtained from photoelectric conversion performed by the corresponding photoelectric conversion device 44, to the side of a signal processing circuit (not shown). The two-dimensional image read-out means 42 still further comprises a plurality of signal lines and scanning lines (not shown), which are connected to the switching devices 45, 45, . . . and are formed in a matrix-like pattern so as to intersect perpendicularly to each other. The photoelectric conversion devices 44, 44, . . . are formed from a dielectric and act also as capacity devices. Specifically, the signal charges obtained from the photoelectric conversion performed by each photoelectric conversion device 44 are accumulated as the latent image charges in the photoelectric conversion device 44.

The grid plate 46 is constituted of radiation absorbing substance regions 46*a*, 46*a*, . . . and radiation-permeable substance regions 46*b*, 46*b*, . . . , which are arrayed alternately at a predetermined grid pitch PG (mm) so as to stand side by side in at least either one of the X direction and the Y direction. (In FIG. 6, the grid array in only one specific direction is shown.)

With the radiation image recording and read-out apparatus 4, a radiation image is recorded with the solid-state radiation detector 40 and read out in the manner described below. Specifically, firstly, the solid-state radiation detector 40 is located such that the scintillator 41 may stand facing the side of the radiation source 8, and radiation carrying image information of the object 9 is irradiated to the scintillator 41. As a result,the radiation impinges directly upon the scintillator 41 and is converted into visible light. The visible light is photoelectrically converted by the photoelectric conversion devices 44, 44, . . . into signal charges, and the signal charges are accumulated as the latent image charges, which carry the radiation image information, by the photoelectric conversion devices 44, 44, . . . The latent image charges are transferred by the switching devices 45, 45, . . . , which are located so as to correspond to the photoelectric conversion devices 44, 44, . . . , to the signal processing circuit (not shown) and are outputted as an image signal.

With the radiation image recording and read-out apparatus 4, wherein the grid plate 46 is employed, as in the improved direct conversion types of radiation image recording and read-out apparatuses 1 and 2 or the direct conversion types of radiation image recording and read-out apparatus 3 described above, the problems concerning the deterioration of the image quality due to the scattered radiation can be eliminated.

The radiation absorbing substance regions 46*a*, 46*a*, . . . and the radiation-permeable substance regions 46*b*, 46*b*, . . . of the grid plate 46 may be arrayed in the same manner as that in the direct conversion type of radiation image recording and read-out apparatus 3 described above. In cases where the relationship between the spatial frequency fP of the photoelectric conversion devices 44, 44, . . . . in the grid array direction, which is represented by the formula of fP=1/PP (cycle/mm), and the spatial frequency fG of the grid pitch, which is represented by the formula of fG=1/PG (cycle/mm), is set in the same manner as that in the radiation image recording and read-out apparatus 3, the same effects as those with the grid array of the grid plate 36 in the direct conversion type of radiation image recording and read-out apparatus 3 described above, can be obtained with the radiation image recording and read-out apparatus 4.

Also, in the embodiment of FIG. 6, as described above with reference to FIGS. 2A, 2B, 2C, and 2D, the radiation image recording and read-out apparatus 4 may be provided with the image processing means for suppressing the signal components SG, which are contained in the image signal having been detected by the two-dimensional image read-out means 42 and which carry the spatial frequency fG of the grid pitch, or the image processing means for suppressing the signal components SM, which are contained in the image signal having been detected by the two-dimensional image read-out means 42 and which carry the moire frequency occurring due to the grid plate 46. In this manner, the grid pattern occurring in the image or the moire occurring in the image can be rendered visually imperceptible.

Figure 7:
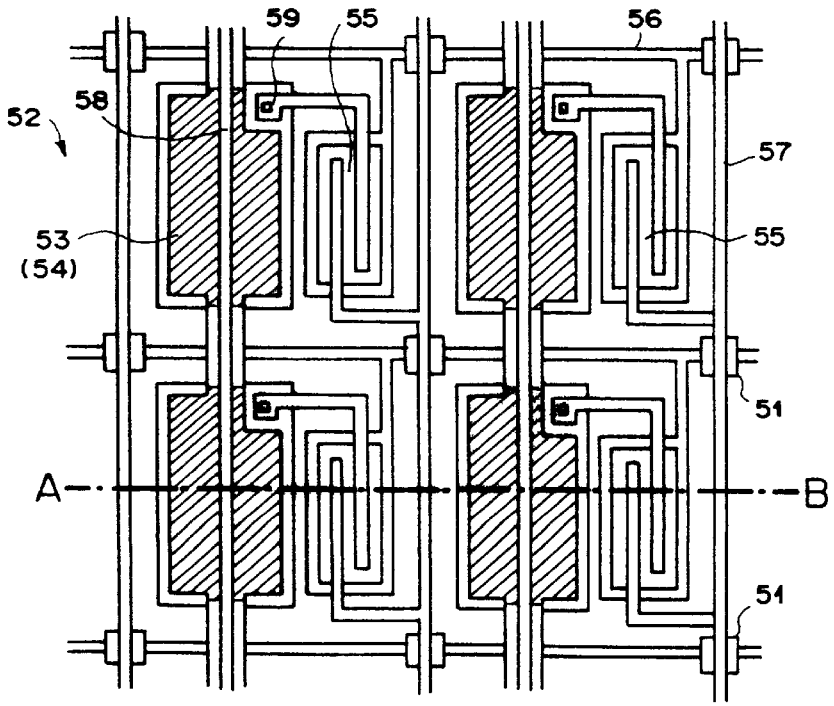
FIG. 7 is a plan view showing two-dimensional image read-out means constituting a photo conversion type of solid-state radiation detector.

FIG. 7 is a plan view showing two-dimensional image read-out means 52, the view serving as an aid in facilitating the explanation of the two-dimensional image read-out means 42 constituting the photo conversion type of solid-state radiation detector 40. In FIG. 7, photoelectric conversion devices and switching devices corresponding to four pixels are shown. In FIG. 7, hatched areas 53, 53, . . . are light receiving surfaces for receiving the fluorescence produced by the scintillator 41. The two-dimensional image read-out means 52 comprises photoelectric conversion devices 54, 54, . . . , and switching devices 55, 55, . . . for transferring the signal charges, which have been obtained from the photoelectric conversion performed by the photoelectric conversion devices 54, 54, . . . , to the side of the signal processing circuit. The two-dimensional image read-out means 52 also comprises scanning lines 56, 56, . . . for controlling the switching devices 55, 55, . . . , and signal lines 57, 57, . . . connected to the signal processing circuit. The two-dimensional image read-out means 52 further comprises electric source lines 58, 58, . . . for giving a bias to the photoelectric conversion devices 54, 54, . . . , and contact holes 59, 59, . . . for connecting the photoelectric conversion devices 54, 54, . . . and the switching devices 55, 55, . . . to each other.

Figure 8:
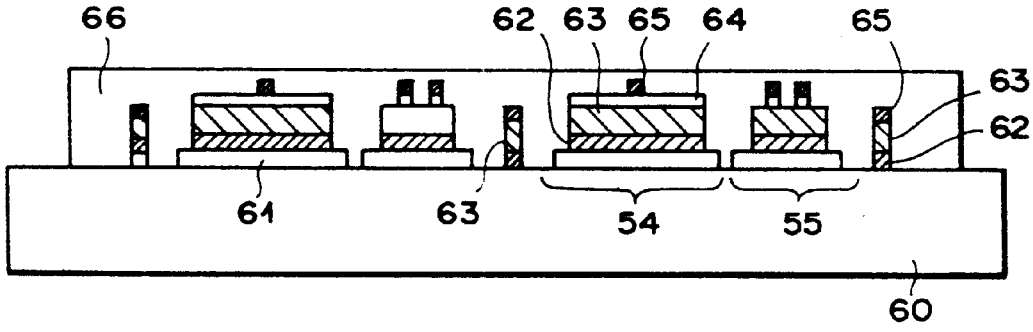
FIG. 8 is a sectional view taken on line A–B of FIG. 7.

FIG. 8 is a sectional view taken on line A–B of FIG. 7. How the two-dimensional image read-out means 52 is produced will be described hereinbelow with reference to FIG. 8.

Firstly, a first thin metal film layer 61 having a thickness of approximately 500 angstroms is formed from chromium Cr on an insulating substrate 60 with a sputtering process or a resistance heating process. Patterning is then performed with photolithography, and unnecessary regions are removed with an etching process. The first thin metal film layer 61 acts as a lower electrode of each photoelectric conversion device 54 and a gate electrode of each switching device 55.

Thereafter, an amorphous silicon nitride insulation layer (a-$SiN_x$) 62 for blocking the passage of electrons and holes and having a thickness of approximately 2,000 angstroms, a hydrogenated amorphous silicon photoelectric conversion layer (a-Si:H) 63 having a thickness of approximately 5,000 angstroms, and an n-type injection blocking layer (N+ layer) 64 for blocking the injection of hole carriers and having a thickness of approximately 500 angstroms are overlaid in the same vacuum with a CVD process. The layers 62, 63, and 64 constitute an insulation layer, a photoelectric conversion semiconductor layer, and a hole injection blocking layer of each photoelectric conversion device 54. The layers 62, 63, and 64 also constitute a gate insulation film, a semiconductor layer, and an ohmic contact layer of each switching device 55. The layers 62, 63, and 64 are further utilized as insulation layers at crossing areas (indicated by the reference numeral 51 in FIG. 7) of the first thin metal film layer 61 and a second thin metal film layer 65.

After the layers have been overlaid, the regions acting as the contact holes 59, 59, . . . are etched with a dry etching process, such as an RIE process or a CDE process. Thereafter, the second thin metal film layer 65 having a thickness of approximately 10,000 angstroms is formed from aluminum Al with the sputtering process or the resistance heating process. Patterning is then performed with photolithography, and unnecessary regions are removed with an etching process.

The second thin metal film layer 65 acts as an upper electrode of each photoelectric conversion device 54, source and drain electrodes of each switching device 55, and wiring (the scanning line 56, the signal line 57, and the electric source line 58). Simultaneously with the formation of the second thin metal film layer 65, the first thin metal film layer 61 and the second thin metal film layer 65 are connected.

In order for a channel area of each switching device 55 to be formed, a portion of the area between the source electrode and the drain electrode is etched with the RIE process. Thereafter, unnecessary areas of the a-$SiN_x$ layer, the a-Si:H layer, and the N+ layer are etched with the RIE process, and the respective devices are separated from one another. In this manner, the photoelectric conversion devices 54, the switching device 55, and scanning line 56, the signal line 57, and the electric source line 58 are formed.

In FIG. 8, the constitution of only two pixels is illustrated. However, a plurality of pixels are formed simultaneously on the insulating substrate 60. Finally, in order for moisture resistance to be enhanced, the respective devices and the wiring are covered with a passivation film (i.e., a protective film) 66.

In the manner described above, the photoelectric conversion devices 54, 54, . . . , the switching devices 55, 55, . . . , and the wiring can be formed simply by etching the first thinmetal film layer 61, the a-$SiN_x$ layer 62, the a-Si:H layer 63, the N+ layer 64, and the second thin metal film layer 65, which have been overlaid simultaneously. At this time, only one injection blocking layer (the N+ layer) 64 is contained in each photoelectric conversion device 54 and can be formed in the same vacuum.

Therefore, the photo conversion type of two-dimensional image read-out means having a large area and high performance can be produced with an ordinary thin film forming apparatus, such as the CVD apparatus or the sputtering apparatus. Also, the two-dimensional image read-out means can be produced with a small number of simple processes, at a high yield, and at a low cost.

In the constitution described above, the relationship between holes and electrons may be reversed. For example, the injection blocking layer may be a p-type layer. In such cases, the application of the voltage and the electric field may be reversed, and the other constituents may be constituted. In this manner, the same operation can be achieved. Also, it is sufficient for the photoelectric conversion semiconductor layer to have the photoelectric conversion functions for generating electron-hole pairs. The photoelectric conversion semiconductor layer may be constituted of a single layer or a plurality of layers.

Further, it is sufficient for the switching device to have a gate electrode, a gate insulation film, a semiconductor layer allowing channel formation, an ohmic contact layer, and a main electrode. For example, the ohmic contact layer may be a p-type layer. In such cases, the voltage for the control of the gate electrode may be reversed, and holes may be utilized as the carriers.

As described above, with the radiation image recording and read-out apparatuses in accordance with the present invention, the grid plate is located between the radiation source and the solid-state radiation detector, the grid plate guiding only the radiation, which comes from a specific direction, to the solid-state radiation detector. Therefore, the radiation scattered in the object is absorbed by the radiation absorbing substance regions of the grid plate. As a result, the problems can be prevented from occurring in that the image quality becomes bad due to the scattered radiation.

Also, in cases where the spatial frequency f0 of the sensor is at least two times as high as the spatial frequency fG of the grid pitch, the striped pattern occurring in the image due to the moire phenomenon can be rendered imperceptible in accordance with the sampling theorem. Further, in cases where the radiation image recording and read-out apparatuses are not constituted such that the spatial frequency f0 of the sensor is at least two times as high as the spatial frequency fG of the grid pitch, the moire frequency may be rendered to be at least 1 cycle/mm, and the number of stripes periodically occurring in the image due to the moire phenomenon may thereby be decreased. In this manner, the striped pattern can be rendered visually imperceptible.

In cases where the radiation image recording and read-out apparatuses in accordance with the present invention are not constituted such that the spatial frequency f0 of the sensor is at least two times as high as the spatial frequency fG of the grid pitch, the signal components SM, which are contained in the image signal having been detected by the two-dimensional image read-out means and which carry the moire frequency occurring due to the grid, may be suppressed. In this manner, the moire occurring in the image can be rendered visually imperceptible. In such cases, there is no risk that the important components of at most 1 cycle/mm, which are contained in the image information, are lost.

Furthermore, in cases where the signal components SG, which are contained in the image signal having been detected by the two-dimensional image read-out means and which carry the spatial frequency fG of the grid pitch, are suppressed, the grid pattern occurring in the image can be rendered visually imperceptible.

Also, the photo conversion type of two-dimensional image read-out means having a large area and high performance can be produced with an ordinary thin film forming apparatus, such as the CVD apparatus or the sputtering apparatus. Further, the two-dimensional image read-out means can be produced with a small number of simple processes, at a high yield, and at a low cost.

What is claimed is:

1. A radiation image recording and read-out method, comprising the steps of:

i) locating a radiation source, which produces radiation, on one side of an object, ii) locating two-dimensional image read-out means on the other side of the object, said two-dimensional image read-out means comprising stripe-shaped electrodes for reading latent image charges, which carry image information, and iii) performing an operation for recording and reading out a radiation image of the object, wherein a grid plate is located between the object and said two-dimensional image read-out means, said grid plate guiding only the radiation, which comes from a specific direction, to said two-dimensional image read-out means, and the operation for recording and reading out the radiation image of the object is performed in this state.

2. A radiation image recording and read-out apparatus, comprising:

i) a radiation source, which produces radiation, ii) two-dimensional image read-out means comprising stripe-shaped electrodes for reading latent image charges, which carry image information, and iii) a grid plate, which is located between said radiation source and said two-dimensional image read-out means, said grid plate guiding only the radiation, which comes from a specific direction, to said two-dimensional image read-out means.

3. An apparatus as defined in claim 2 wherein said stripe-shaped electrodes of said two-dimensional image read-out means are arrayed at a predetermined pitch so as to stand side by side in a direction, which is approximately normal to a longitudinal direction of each stripe-shaped electrode, said grid plate is constituted of radiation absorbing substance regions and radiation-permeable substance regions, which are arrayed alternately at a predetermined grid pitch so as to stand side by side in the direction approximately normal to the longitudinal direction of each stripe-shaped electrode, and a spatial frequency of the pitch of said stripe-shaped electrodes is at least two times as high as a spatial frequency of the grid pitch.

4. An apparatus as defined in claim 2 wherein said stripe-shaped electrodes of said two-dimensional image read-out means are arrayed at a predetermined pitch so as to stand side by side in a direction, which is approximately normal to a longitudinal direction of each stripe-shaped electrode, said grid plate is constituted of radiation absorbing substance regions and radiation-permeable substance regions, which are arrayed alternately at a predetermined grid pitch so as to stand side by side in the longitudinal direction of each stripe-shaped electrode, and a spatial frequency of a sampling pitch, at which the latent image charges are read with scanning in the longitudinal direction of each stripe-shaped electrode, is at least two times as high as a spatial frequency of the grid pitch.

5. An apparatus as defined in claim 2 wherein said stripe-shaped electrodes of said two-dimensional image read-out means are arrayed at a predetermined pitch so as to stand side by side in a direction, which is approximately normal to a longitudinal direction of each stripe-shaped electrode, said grid plate is constituted of radiation absorbing substance regions and radiation-permeable substance regions, which are arrayed alternately at a predetermined grid pitch so as to stand side by side in the direction approximately normal to the longitudinal direction of each stripe-shaped electrode, and a difference between a spatial frequency of the pitch of said stripe-shaped electrodes and a spatial frequency of the grid pitch is at least 1 cycle/mm.

6. An apparatus as defined in claim 2 wherein said stripe-shaped electrodes of said two-dimensional image read-out means are arrayed at a predetermined pitch so as to stand side by side in a direction, which is approximately normal to a longitudinal direction of each stripe-shaped electrode, said grid plate is constituted of radiation absorbing substance regions and radiation-permeable substance regions, which are arrayed alternately at a predetermined grid pitch so as to stand side by side in the longitudinal direction of each stripe-shaped electrode, and a difference between a spatial frequency of a sampling pitch, at which the latent image charges are read with scanning in the longitudinal direction of each stripe-shaped electrode, and a spatial frequency of the grid pitch is at least 1 cycle/mm.

7. A radiation image recording and read-out method, comprising the steps of:

i) locating a radiation source, which produces radiation, on one side of an object, ii) locating two-dimensional image read-out means and a radio-conductive material, which is formed on said two-dimensional image read-out means, on the other side of the object, said two-dimensional image read-out means comprising an insulating substrate and a plurality of charge collecting electrodes, which are formed in a two-dimensional pattern on said insulating substrate and each of which corresponds to a single pixel, said radio-conductive material generating electric charges carrying image information when it is exposed to radiation carrying the image information, and iii) performing an operation for recording and reading out a radiation image of the object, wherein a grid plate is located between the object and said radio-conductive material, said grid plate guiding only the radiation, which comes from a specific direction, to said radio-conductive material, and the operation for recording and reading out the radiation image of the object is performed in this state.

8. A radiation image recording and read-out apparatus, comprising:

i) a radiation source, which produces radiation, ii) two-dimensional image read-out means comprising an insulating substrate and a plurality of charge collecting electrodes, which are formed in a two-dimensional pattern on said insulating substrate and each of which corresponds to a single pixel, iii) a radio-conductive material, which is formed on said two-dimensional image read-out means, said radio-conductive material generating electric charges carrying image information when it is exposed to radiation carrying the image information, and iv) a grid plate, which is located between said radiation source and said radio-conductive material, said grid plate guiding only the radiation, which comes from a specific direction, to said radio-conductive material.

9. An apparatus as defined in claim 8 wherein said charge collecting electrodes of said two-dimensional image read-out means are arrayed at a predetermined pitch in an X direction and at a predetermined pitch in a Y direction, said grid plate is constituted of radiation absorbing substance regions and radiation-permeable substance regions, which are arrayed alternately at a predetermined grid pitch so as to stand side by side in at least either one of the X direction and the Y direction, and a spatial frequency of said charge collecting electrodes in the grid array direction is at least two times as high as a spatial frequency of the grid pitch.

10. An apparatus as defined in claim 8 wherein said charge collecting electrodes of said two-dimensional image read-out means are arrayed at a predetermined pitch in an X direction and at a predetermined pitch in a Y direction, said grid plate is constituted of radiation absorbing substance regions and radiation-permeable substance regions, which are arrayed alternately at a predetermined grid pitch so as to stand side by side in at least either one of the X direction and the Y direction, and a difference between a spatial frequency of said charge collecting electrodes in the grid array direction and a spatial frequency of the grid pitch is at least 1 cycle/mm.

11. A radiation image recording and read-out apparatus, comprising:

i) a radiation source, which produces radiation, ii) two-dimensional image read-out means comprising an insulating substrate and a plurality of photoelectric conversion devices, which are formed in a two-dimensional pattern on said insulating substrate and each of which corresponds to a single pixel, iii) a fluorescent material, which is formed on said two-dimensional image read-out means, said fluorescent material converting radiation carrying image information into visible light carrying the image information when it is exposed to the radiation carrying the image information, and iv) a grid plate, which is located between said radiation source and said fluorescent material, said grid plate guiding only the radiation, which comes from a specific direction, to said fluorescent material, wherein said photoelectric conversion devices of said two-dimensional image read-out means are arrayed at a predetermined pitch in an X direction and at a predetermined pitch in a Y direction, said grid plate is constituted of radiation absorbing substance regions and radiation-permeable substance regions, which are arrayed alternately at a predetermined grid pitch so as to stand side by side in at least either one of the X direction and the Y direction, and a spatial frequency of said photoelectric conversion devices in the grid array direction is at least two times as high as a spatial frequency of the grid pitch.

12. A radiation image recording and read-out apparatus, comprising:

i) a radiation source, which produces radiation, ii) two-dimensional image read-out means comprising an insulating substrate and a plurality of photoelectric conversion devices, which are formed in a two-dimensional pattern on said insulating substrate and each of which corresponds to a single pixel, iii) a fluorescent material, which is formed on said two-dimensional image read-out means, said fluorescent material converting radiation carrying image information into visible light carrying the image information when it is exposed to the radiation carrying the image information, and iv) a grid plate, which is located between said radiation source and said fluorescent material, said grid plate guiding only the radiation, which comes from a specific direction, to said fluorescent material, wherein said photoelectric conversion devices of said two-dimensional image read-out means are arrayed at a predetermined pitch in an X direction and at a predetermined pitch in a Y direction, said grid plate is constituted of radiation absorbing substance regions and radiation-permeable substance regions, which are arrayed alternately at a predetermined grid pitch so as to stand side by side in at least either one of the X direction and the Y direction, and a difference between a spatial frequency of said photoelectric conversion devices in the grid array direction and a spatial frequency of the grid pitch is at least 1 cycle/mm.

13. An apparatus as defined in claim 11 or 12 wherein each of said photoelectric conversion devices comprises:

a) a first thin metal film layer, which acts as a lower electrode, b) an amorphous silicon nitride insulation layer (a-$SiN_x$), which blocks passage of electrons and holes, c) a hydrogenated amorphous silicon photoelectric conversion layer (a-Si:H), d) an injection blocking layer selected from the group consisting of an n-type injection blocking layer, which blocks injection of hole carriers, and a p-type injection blocking layer, which blocks injection of electron carriers, and e) a layer selected from the group consisting of a transparent electrode layer, which acts as an upper electrode, and a second thin metal film layer, which is formed on a portion of said injection blocking layer, the layers being overlaid in this order on said insulating substrate.

14. An apparatus as defined in claim 2, 3, 4, 5, 6, 8, 9, 10, 11 or 12 wherein the apparatus is provided with first image processing means for suppressing signal components, which are contained in an image signal having been detected by said two-dimensional image read-out means and which carry a spatial frequency of a grid pitch.

15. An apparatus as defined in claim 13 wherein the apparatus is provided with first image processing means for suppressing signal components, which are contained in an image signal having been detected by said two-dimensional image read-out means and which carry a spatial frequency of a grid pitch.

16. An apparatus as defined in claim 2, 3, 5, 6, 8, 10, or 12 wherein the apparatus is provided with second image processing means for suppressing signal components, which are contained in an image signal having been detected by said two-dimensional image read-out means and which carry a moire frequency occurring due to the grid.

17. An apparatus as defined in claim 13 wherein the apparatus is provided with second image processing means for suppressing signal components, which are contained in an image signal having been detected by said two-dimensional image read-out means and which carry a moire frequency occurring due to the grid.

18. An apparatus as defined in claim 14 wherein the apparatus further comprises an analog-to-digital converter for converting the image signal, which has been detected by said two-dimensional image read-out means, into a digital image signal, and said image processing means performs processing for suppressing the signal components on the digital image signal.

19. An apparatus as defined in claim 15 wherein the apparatus further comprises an analog-to-digital converter for converting the image signal, which has been detected by said two-dimensional image read-out means, into a digital image signal, and said image processing means performs processing for suppressing the signal components on the digital image signal.

20. An apparatus as defined in claim 16 wherein the apparatus further comprises an analog-to-digital converter for converting the image signal, which has been detected by said two-dimensional image read-out means, into a digital image signal, and said image processing means performs processing for suppressing the signal components on the digital image signal.

21. An apparatus as defined in claim 17 wherein the apparatus further comprises an analog-to-digital converter for converting the image signal, which has been detected by said two-dimensional image read-out means, into a digital image signal, and said image processing means performs processing for suppressing the signal components on the digital image signal.

* * * * *